US009410349B2

(12) United States Patent
Hapke et al.

(10) Patent No.: US 9,410,349 B2
(45) Date of Patent: Aug. 9, 2016

(54) APPLIANCE LATCH WITH IMPROVED DOOR RETENTION AT ELEVATED TEMPERATURES

(75) Inventors: Kenyon A. Hapke, Libertyville, IL (US); Adrian J. Tengler, New Berlin, WI (US)

(73) Assignee: Illinois Tool Works Inc., Glenview, IL (US)

( * ) Notice: Subject to any disclaimer, the term of this patent is extended or adjusted under 35 U.S.C. 154(b) by 920 days.

(21) Appl. No.: 13/636,202

(22) PCT Filed: Apr. 14, 2011

(86) PCT No.: PCT/US2011/032406

§ 371 (c)(1), (2), (4) Date: Sep. 20, 2012

(87) PCT Pub. No.: WO2011/139506

PCT Pub. Date: Nov. 10, 2011

(65) Prior Publication Data

US 2013/0008046 A1 Jan. 10, 2013

Related U.S. Application Data

(60) Provisional application No. 61/327,945, filed on Apr. 26, 2010.

(51) Int. Cl.
*E05C 19/00* (2006.01)
*E05C 19/06* (2006.01)
(Continued)

(52) U.S. Cl.
CPC ..... *E05C 19/063* (2013.01); *D06F 37/42* (2013.01); *D06F 39/14* (2013.01); *D06F 58/28* (2013.01);
(Continued)

(58) Field of Classification Search
CPC ..... E05B 2015/0458; E05B 2015/0403; E05B 51/02; E05B 65/104; E05B 15/04; E05B 17/20; E05B 17/2007; E05B 17/2034; E05B 17/2038; E05B 47/0009; E05B 47/0607; E05B 2015/0235; E05C 19/063; E05C 19/06; D06F 37/42; D06F 39/14; D06F 58/28; D06F 2058/2858; Y10T 292/438; Y10S 292/69
USPC ..... 292/303, 80, 81, 341.15, 341.16, 87, 292/300, DIG. 38, DIG. 41, DIG. 61, DIG. 69
See application file for complete search history.

(56) References Cited

U.S. PATENT DOCUMENTS 1,642,278 A * 9/1927 Vanderlipp ..... F16B 2/248 24/581.1
2,317,277 A 4/1943 Knuth
2,526,790 A * 10/1950 Wroblewski ..... F16B 21/078 24/110

(Continued)

FOREIGN PATENT DOCUMENTS

EP 0003350 A1 8/1979
WO 2009129073 A1 10/2009

OTHER PUBLICATIONS

An International Search Report and Written Opinion, dated Aug. 23, 2011, in International Application No. PCT/US2011/032406.

*Primary Examiner* — Kristina Fulton
*Assistant Examiner* — Christine M Mills

(57) ABSTRACT

A door latch for an appliance provides a U-shaped spring for engaging a strike having an expanded tip and passing between the arms of the U-shaped spring in a direction substantially perpendicular to the extent of those arms. Locking of the latch may be provided by collaring the distal ends of the arms to prevent their expansion once the strike is engaged.

11 Claims, 4 Drawing Sheets

(51) Int. Cl.

| | |
|---|---|
| ***D06F 37/42*** | (2006.01) |
| ***D06F 39/14*** | (2006.01) |
| ***D06F 58/28*** | (2006.01) |
| ***E05B 47/00*** | (2006.01) |
| ***E05B 47/06*** | (2006.01) |
| *E05B 15/04* | (2006.01) |
| *E05B 17/20* | (2006.01) |
| *E05B 15/02* | (2006.01) |

(52) U.S. Cl.
CPC ..... *E05B 17/2034* (2013.01); *E05B 17/2038* (2013.01); *E05B 47/0009* (2013.01); *E05B 47/0607* (2013.01); *D06F 2058/2858* (2013.01); *E05B 15/04* (2013.01); *E05B 17/20* (2013.01); *E05B 17/2007* (2013.01); *E05B 2015/0235* (2013.01); *E05C 19/06* (2013.01); *Y10S 292/69* (2013.01); *Y10T 292/438* (2015.04)

(56) References Cited

U.S. PATENT DOCUMENTS

| | | | | | |
|---|---|---|---|---|---|
| 2,840,405 | A * | 6/1958 | Feltz | E05B 47/0002 | 109/63.5 |
| 3,235,299 | A | 2/1966 | Kobryner | | |
| 3,450,851 | A * | 6/1969 | Perl | A47L 15/4259 | 134/58 DL |
| 3,764,172 | A * | 10/1973 | Standke | E05B 47/0002 | 292/15 |
| 4,535,870 | A * | 8/1985 | Lindsay | H04B 1/088 | 181/141 |
| 5,119,653 | A * | 6/1992 | Mazzotta | B63B 17/02 | 70/169 |
| 2003/0000149 | A1* | 1/2003 | Oakley | E05B 83/42 | 49/449 |
| 2009/0167126 | A1* | 7/2009 | Yoon | D06F 37/42 | 312/326 |
| 2009/0260198 | A1 | 10/2009 | Morgan et al. | | |
| 2010/0097223 | A1* | 4/2010 | Kruest | E05B 47/0009 | 340/572.1 |

* cited by examiner

APPLIANCE LATCH WITH IMPROVED DOOR RETENTION AT ELEVATED TEMPERATURES

RELATED APPLICATIONS

This application is based on International Application No. PCT/US 2011/032406, filed Apr. 14, 2011 and claims the benefit of U.S. provisional application 61/327,945, filed Apr. 26, 2010.

FIELD OF THE INVENTION

The present invention relates to an appliance latch and in particular to a latch assembly retaining door closure in the event of a fire in the dryer.

BACKGROUND OF THE INVENTION

Clothes dryers may employ a rotating perforated drum into which clothes are placed and tumbled within circulation of heated air to dry the clothes. The drum may be accessible for loading and removing clothing through an opening in the front of the dryer cabinet that may be covered by a hinged door when the dryer is in use. Typically, the door is held closed by a spring latch that retains the door closed against the light force of tumbling clothing but that may be readily opened at any time by a higher force applied to the dryer door handle by the user.

In some situations, it may be desirable to provide a latch that will maintain the door in the closed position under elevated temperatures that may melt plastic components. In this way, in the event of a fire in the interior of the dryer, the door will remain closed confining the fire to the interior.

One such latch is described in US patent application 2009/0260198, assigned to the assignee of the present invention and hereby incorporated by reference, which discloses a strike having a bulbous tip that may be received between plastic jaws of a spring clip. The plastic jaws are biased by a metallic U-shaped spring having arms that open by deflecting or pivoting about an axis generally perpendicular to the motion of the strike. The arms of a metallic spring pass through the plastic jaws so that should the plastic jaws melt, the ends of the arms are nevertheless close enough to the strike to grip and retain the strike when the plastic jaws are gone. The plastic jaws, during normal operation, reduce the friction of engagement and disengagement of the latch with the strike.

A U-shaped spring holding the plastic jaws is attached at its base to a metal U-shaped bracket surrounding the U-shaped spring having legs extending forward to attach to the housing of the dryer behind an opening through which the strike would make pass. This metal U-shaped bracket holds the U-shaped spring in proper position even in the event of a fire.

SUMMARY OF THE INVENTION

The present invention provides a latch for a clothes dryers or the like in which the U-shaped spring of the prior art is rotated by 90 degrees so that the arms of the U-shaped spring clip pivot about axes generally parallel to the motion of the strike and the arms of the U-shaped spring clip extend across the strike and the opening. This configuration permits elimination of the U-shaped bracket permitting instead a simple plastic support because the U-shaped spring clip has an orientation that may retain itself on the strike and block retraction of the strike even in the absence of the support bracket.

This orientation further permits greater flexibility in controlling the spring clip force constant in a shallow form factor. Finally, this orientation permits locking of the strike to be simply accomplished by collaring the ends of the U-shaped spring clip, these ends being displaced from and thus free from interference with the strike itself.

Specifically the present invention provides a latch strike retention assembly adapted to accept and retain a latch strike and including a substantially "U" shaped spring having opposing and substantially parallel arm portions extending from a common base portion. A support bracket holds the U-shaped spring behind an opening through which the strike must pass so that the arm portions of the U-shaped spring extend generally perpendicular to a direction of strike engagement with the arm portions, and the arm portions may flexibly separate within a plane perpendicular to the direction of latch engagement to receive and restrain the strike therebetween.

It is thus a feature of at least one embodiment of the invention to provide a latch with a shallow form factor. It is a further feature of this embodiment to permit use of a simple support bracket which may be in its simplest form a thin plate which does not require high-strength materials for proper support of the U-shaped spring.

The support bracket may be a thermoplastic material.

It is thus a feature of at least one embodiment of the invention to provide a design permitting a readily manufacturable injection molded support bracket while still ensuring that the door will remain latched at elevated temperatures that might melt or burn plastic. By sizing the U-shaped spring to be larger than the aperture and orienting the U-shaped spring across the aperture, retention of the strike may be maintained even without the support bracket.

The support bracket may include apertures receiving arm portions of the U-shaped spring when the arm portions are inserted into the apertures along the plane and may include a snap element capturing the based portion of the U-shaped spring against extraction from the apertures along the plane after insertion of the arm portions into the apertures past the snap element.

It is thus a feature of at least one embodiment of the invention to retain the elements of the latch together for easy manufacture while permitting necessary motion of the U-shaped spring.

The U-shaped spring is a single rod of substantially circular cross-section.

It is thus a feature of at least one embodiment of the invention to provide an extremely simple wire-form latch element whose orientation permits the necessary flexibility to be obtained in an arbitrary wire size. It is another feature of at least one embodiment of the invention to provide an outer surface of the U-shaped spring conducive to smooth engagement with a tapered strike.

The arm portions of the U-shaped spring distal to a point of engagement with the strike may have an un-flexed separation smaller than a corresponding thickness of the strike between the arm portions when the strike is engaged with the U-shaped spring, and/or the arm portions of the U-shaped spring at a point of engagement with the strike may have an un-flexed separation smaller than a corresponding thickness of the strike at the point of engagement.

It is thus a feature of at least one embodiment of the invention to ensure that the U-shaped spring is retained on the strike even in the absence of the support plate.

The U-shaped spring may extend at least three times the width of the base portion measured perpendicularly to the extent of the arm portions.

It is thus a feature of at least one embodiment of the invention to provide a substantially parallel separation of the arm portions of the U-shaped spring for robust engagement with the strike. It is another feature of at least one embodiment of the invention to permit engagement of the strike at a variety of positions along the U-shaped spring to accommodate vertical strike movement resulting from manufacturing tolerances and/or door hinge sag.

The latch strike may further include a collar movable relative to the U-shaped spring between: (a) a first locked position at least partially surrounding the arm portions of the U-shaped spring preventing separation of the arm portions to release the strike after the strike has passed through the U-shaped spring, and (b) a second unlocked position removed from the arm portions of the U-shaped spring permitting separation of the arm portions to release the strike after the strike has passed through the U-shaped spring.

It is thus a feature of at least one embodiment of the invention to provide a latch permitting simple addition of a locking function.

The U-shaped spring may be held substantially fixed with respect to the support bracket and the collar is movable with respect to the support bracket.

It is thus a feature of at least one embodiment of the invention to permit a locking during engagement of the latch and strike such as may impart a high frictional resistance to movement of the U-shaped spring.

The latch strike retention assembly may further include an electrically powered actuator moving the collar with respect to the support bracket between the locked and unlocked position in response to an electrical signal.

It is thus a feature of at least one embodiment of the invention to permit automatic locking of the door at certain appliance operating stages.

The actuator may be at least one electrical solenoid and/or may include a thermal actuator preventing movement of the collar from the locked to the unlocked position when power is disconnected from the electrical solenoid for a predetermined period of time corresponding to a thermal cooling.

It is thus a feature of at least one embodiment of the invention to permit rapid locking action as may be necessary for certain safety features while ensuring residual locking even under power loss conditions that nevertheless ultimately permit access through an unlocked door.

The latch strike retention may further include a strike sensor communicating with a first contact set to provide a signal dependent on engagement of the strike with the U-shaped spring.

It is thus a feature of at least one embodiment of the invention to permit determination of proper door position for locking.

The collar may further communicate with the first contacts to provide a signal dependent on engagement of the collar with the arm portions of the U-shaped spring.

It is thus a feature of at least one embodiment of the invention to permit a single signal to be used for effective lock control. By providing a signal only when the strike is in position and the collar properly placed, door closure can be detected by momentary operation of the electronic actuator and monitoring of the contacts, and complete locking may be confirmed by closure of the contacts.

Other features and advantages of the invention will become apparent to those skilled in the art upon review of the following detailed description, claims and drawings in which like numerals are used to designate like features.

Figure 1:
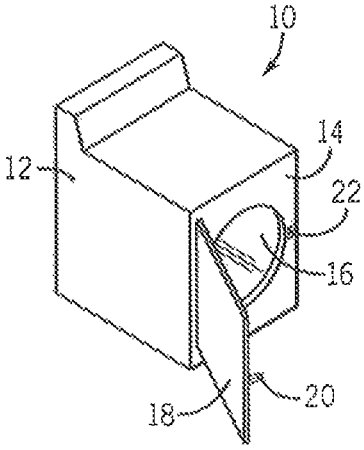
FIG. 1 is a perspective view of a typical clothes dryer such as may employ the present invention showing locations of the strike and latch mechanism, the latter behind a front panel of the dryer.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, an appliance 10, such as the dryer, may provide for a housing 12 generally constructed of enameled steel or the like. The housing 12 may have a front panel 14 providing a drum access opening 16 leading to the dryer drum for the insertion and removal of clothes therethrough. The drum access opening 16 may be covered during use of the appliance 10 by a hinged door 18 having a door strike 20 attached to an outer edge of the rear of the door 18 to extend rearward therefrom. The door strike 20 may be received through a latch opening 22 in the front panel 14 to be retained by a latch mechanism (not shown in FIG. 1) as will be described.

Figure 2:
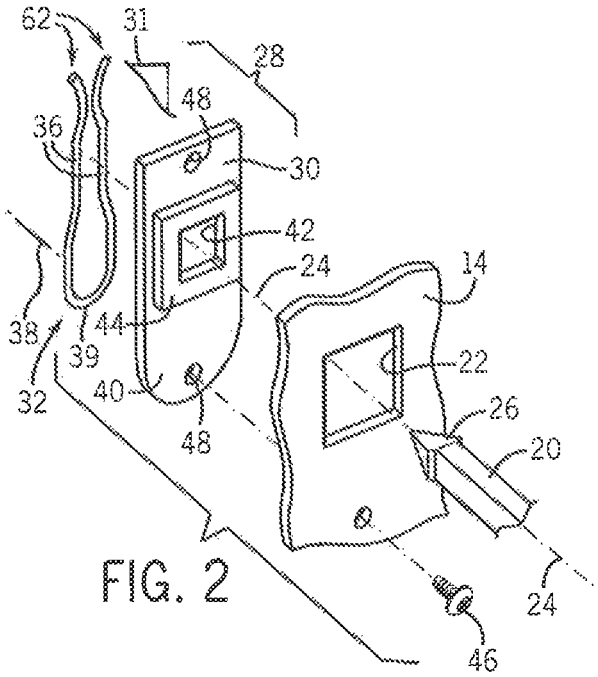
FIG. 2 is an exploded fragmentary diagram of the latch mechanism positioned behind an opening in the front panel of the dryer, the latch mechanism including a plastic retainer element and U-shaped spring clip such as may receive a bulbous tip of a strike.

Referring now to FIG. 2, the strike 20 may extend generally along an axis 24 that also describes the local motion of the strike 20 as the door 18 is closed. The leading edge of the strike 20 as the door 18 is closed, and as is positioned toward the latch opening 22, provides a bulbous end 26 that permits its retention by the strike retention mechanism 28 behind the latch opening 22.

The strike retention mechanism 28 may include a U-shaped spring 32 and a support bracket 30 constructed of injection-molded thermoplastic. The U-shaped spring 32 provides two upwardly extending arms 36 formed by bending a round cross-section of steel wire in a U-shape until the arms 36 are substantially parallel as extending away from a base 39. During use, as will be described, arms 36 may flex to pivot apart about an approximate pivot axis 38 parallel to but displaced from the axis 24 and in a plane 31 generally perpendicular to the axis 24 to admit the bulbous end 26 of the strike 20.

The U-shaped spring 32 is retained in proper position to receive the strike 20 as corralled by the support bracket 30 which includes an escutcheon panel 40 abutting a rear surface of the front panel 14. The escutcheon panel 40 includes an escutcheon aperture 42 allowing the strike 20 to pass through the escutcheon panel 40 to be received between the arms 36 of the U-shaped spring 32. The escutcheon aperture 42 is surrounded by a collar 44 which has an outer periphery fitting snugly into the latch opening 22 of the front panel 14 and a beveled interior periphery helping to funnel the strike 20 into alignment with the escutcheon aperture 42. The escutcheon panel 40 may be held against the front panel 14 by means of one or more screws 46 (only one shown for clarity) received by corresponding bores 48 in the escutcheon panel 40.

Figure 4:
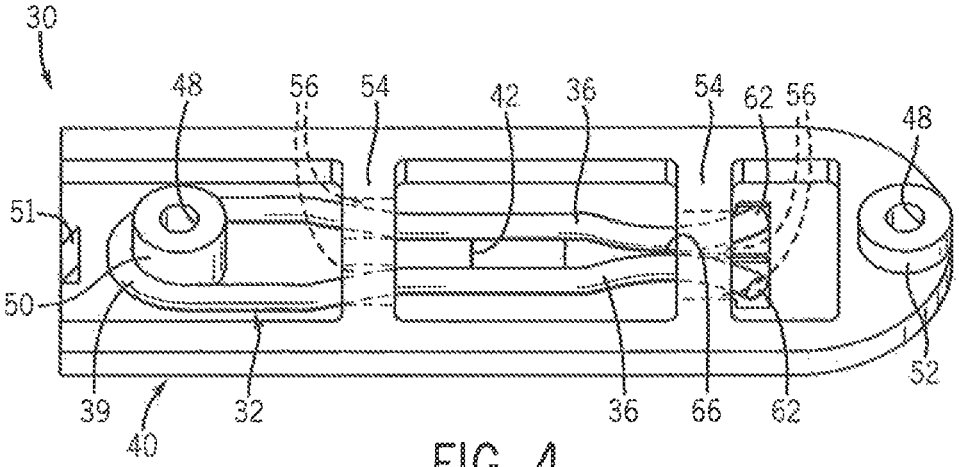
FIG. 4 is an orthogonal view of the rear of the latching mechanism of FIG. 2 as assembled showing the retention of the U-shaped spring clip beneath bridges formed in the plastic retainer element as retained by a snap ramp.

Referring now to FIG. 4, the base 39 of the U-shaped spring 32 may fit around a boss 50 extending rearwardly from a rear surface of the escutcheon panel 40 about bores 48 beneath the escutcheon aperture 42. The arms 36 of the U-shaped spring 32 may then extend upward toward a second boss 52 extending rearwardly from a rear surface of the escutcheon panel 40 about a second bore 48 above the escutcheon aperture 42. The bosses 50 and 52 provide a surface for thread engagement by the screws 46 (shown in FIG. 2). The arms 36 may be retained by molded bridge elements 54 on the rear surface of the escutcheon panel 40 having internal apertures 56 through which the arms 36 may pass while still providing for their ability to flex outward to receive the strike 20 through the escutcheon aperture 42. The U-shaped spring 32 may be retained against removal from the apertures 56 by a snap element 51. The snap element 51 provides a ramp surface assisting in sliding the U-shaped spring 32 into the apertures 35 along the plane, but a blocking surface preventing the reverse motion.

Figure 3A:
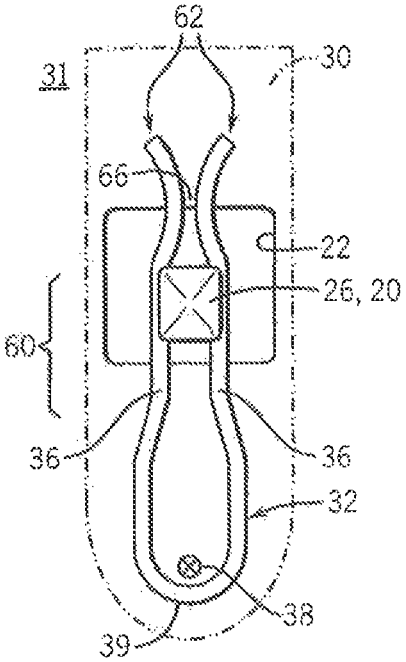
FIGS. 3*a-c* are front elevational, fragmentary side elevational and fragmentary top plan views of the strike engaged with the latch mechanism of FIG. 2 showing blocking of the strike from retraction through the opening in the cabinet even without the plastic retainer element.
Figure 3C:
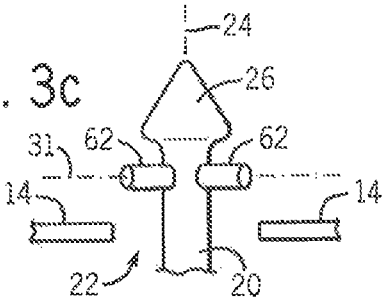
Figure 3B:
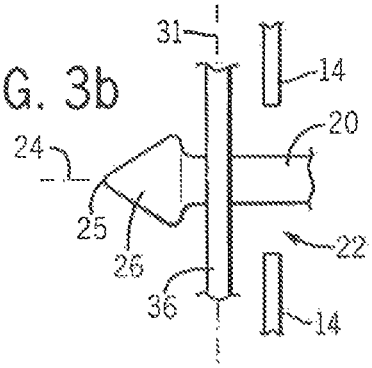

Referring now to FIGS. 3*a-c*, the strike 20 may engage the U-shaped spring 32 after the bulbous end 26 of the strike 20 passes through an engagement plane 31 in which the arms 36 of the U-shaped spring 32 lie. The arms 36 of the U-shaped spring 32 will generally be parallel to each other for a height 60 suitable to accommodate different elevational positions of the strike 20 as may result from a sagging of the door 18 over time. The distal ends 62 of the arms 36 removed from the base 39 of the U-shaped spring 32 may be bent inward toward each other to have a reduced separation 66 when the parallel portions of the arms 36 of the U-shaped spring 32 are relaxed less than the horizontal width of the strike 20 between the arms 36. More generally, the relaxed separation of the arms 36 may be less than the horizontal width of the strike 20 between the arms 36. In these ways, even in the absence of the support bracket 30, for example when melted or deformed, the U-shaped spring 32 will retain its grip on the strike 20 and be in a position to prevent withdrawal of the strike 20 through the latch opening 22 without application of force sufficient to spread the arms 36 apart as would be required during normal latching operation.

Referring momentarily also to FIG. 2, the bulbous end 26 of the strike 20 may have its leading apex 25 displaced upward with respect to an axis of the shaft of the strike 20 reflecting a predominance of downward displacement of the strike 20 over time with door sag. Further, the escutcheon aperture 42 may have a peripheral bevel to assist in guiding the bulbous end 26 of the strike 20 into the escutcheon aperture 42.

Figure 5:
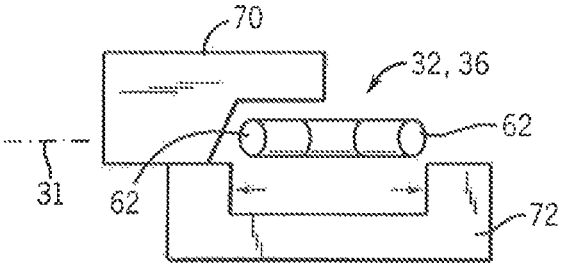
FIGS. 5 and 6 are top plan views of the ends of the U-shaped spring clip in an embodiment where the ends may be moved out of a normal plane of the U-shaped spring clip within walls of a collar to prevent them from separating such as would permit release of the strike to provide a locking action.
Figure 6:
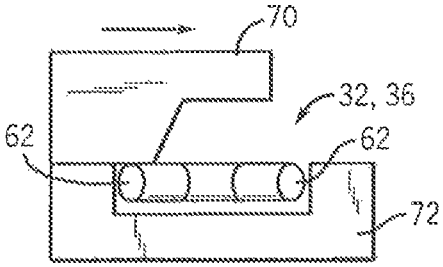

Referring now to FIG. 5, the strike retention mechanism 28 may also provide a locking function preventing engagement or disengagement of the strike 20. This locking may be accomplished by preventing a separation of the distal ends 62 of the arms 36 after they have received the bulbous end 26 of the strike 20. In one embodiment, this may be accomplished by means of a locking wedge 70 fixed on the support bracket 30 whose movement along the plane 31 across the distal ends 62 (as shown in FIG. 6) presses the distal ends 62 of the U-shaped spring 32 downward out of the plane 31 into an upwardly facing C collar 72 that prevents separation of the arms 36 and thus disengagement of the strike 20. The locking wedge 70 may be moved by an electrical solenoid or the like.

Figure 7A:
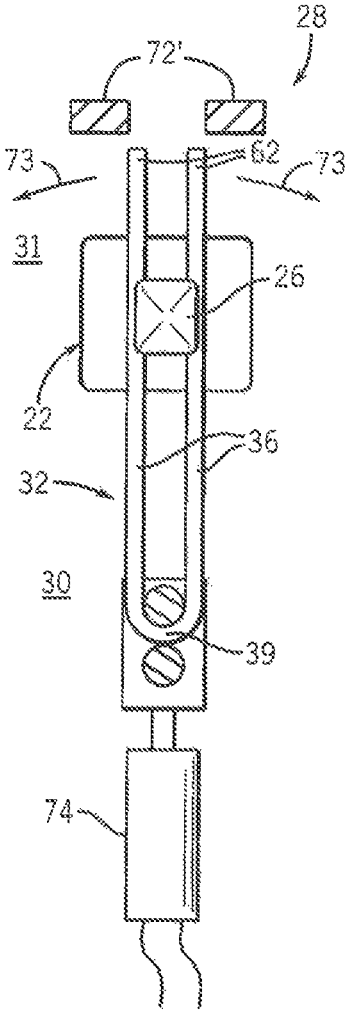
FIGS. 7*a* and 7*b* are front elevational views of the U-shaped spring clip in an embodiment in which the spring clip is moved along the plane by an electric actuator to place the ends in between the walls of a collar to provide a locking.
Figure 7B:
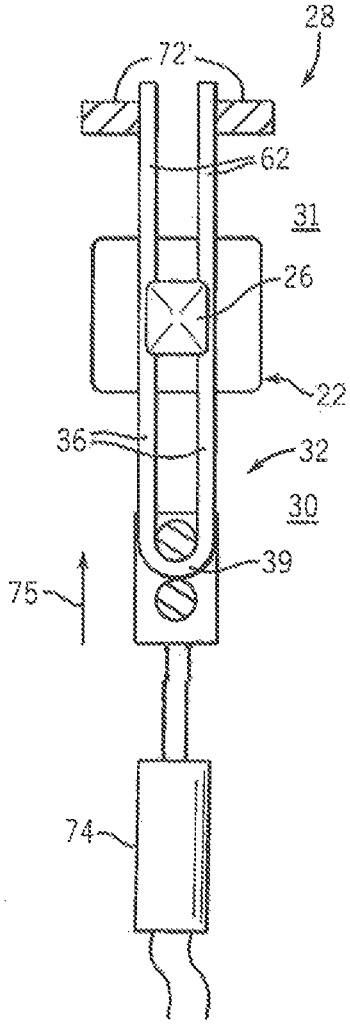

Referring now to FIGS. 7*a* and 7*b*, in an alternative embodiment, the separation of the distal ends 62 of the arms 36 of the U-shaped spring 32, indicated by arrows 73, may be prevented by sliding of the U-shaped spring 32 with respect to the support bracket 30 into a collar 72' fixed on the support bracket 30. The sliding is along the plane 31 generally in the direction 75 of the extent of the arms 36. In this embodiment, the reduced separation 66 portion of the arms 36 is not required and those arms 36 may be substantially straight.

Movement of the U-shaped spring 32 in this manner may be accomplished by an electric actuator 74 attached to the base 39, directly or through a linkage or the like, to allow both electrically controlled unlocking and locking with opposite motions of the electric actuator 74. The electric actuator 74 may be any of a variety of electric actuators including single solenoids with permanent magnet cores, a single solenoid with a spring bias, opposed dual solenoids with standard ferromagnetic cores, wax motors, and bimetallic elements, electric motors, or the like.

Figure 8B:
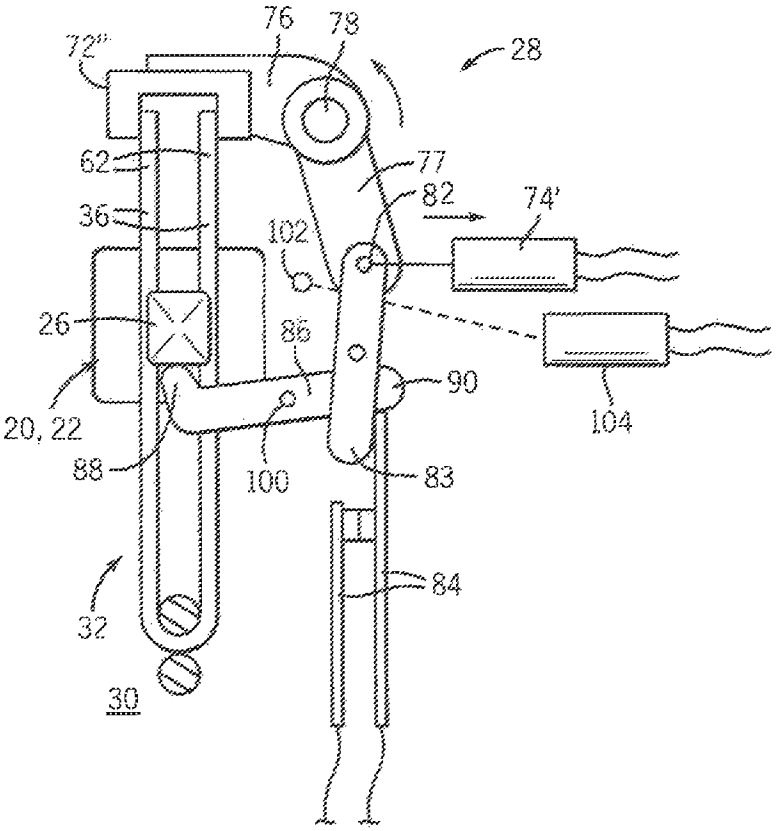
FIGS. 8*a* and 8*b* are figures similar to those of FIGS. 7*a* and 7*b* showing a movable collar for providing a locking action.
Figure 8A:
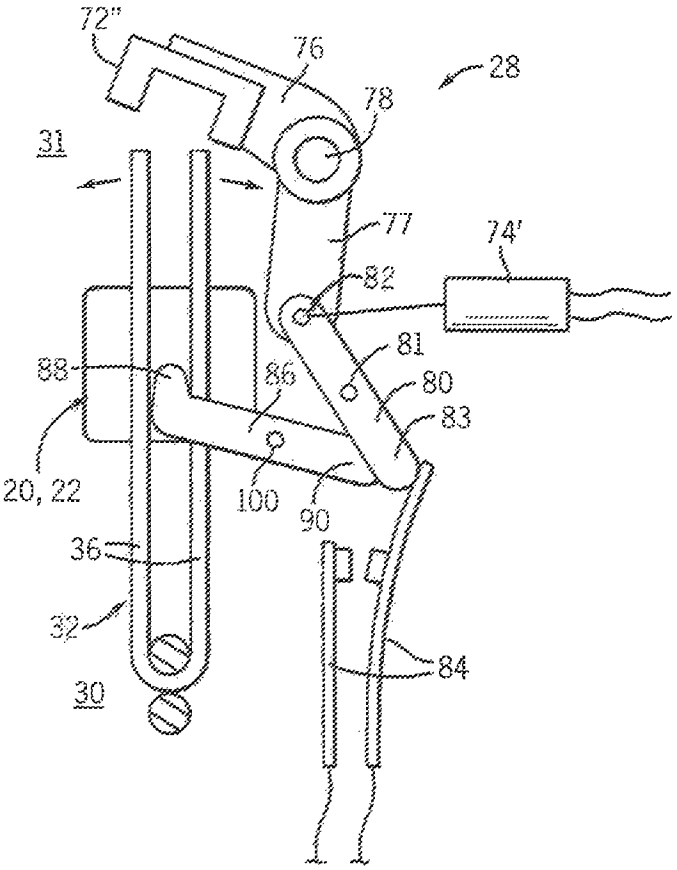

Referring now to FIGS. 8*a* and 8*b*, in an alternative embodiment, the U-shaped spring 32 may remain stationary with respect to the support bracket 30 and a collar 72" may be moved into engagement (as shown in FIG. 8*a*) or disengagement (as shown in FIG. 8*b*) about the distal ends 62 of the U-shaped spring 32. The collar 72" may be mounted on a lever arm 76 to pivot about a pivot point 78 of the support bracket 30 under the control of actuator 74'. The actuator 74' may be attached to an extension 77 of lever arm 76 on an opposite side of the pivot point 78. This extension 77 may be in turn attached to a switch linkage 80 by a slide/pivot connection 82. Movement of the extension 77 moves the switch linkage 80 about a pivot point 81 so that its end 83 opposite slide/pivot connection 82 opens a set of contacts 84 when the collar 72" is disengaged from the distal ends 62 (as shown in FIG. 8*a*). When the collar 72" is engaged with the distal ends 62, preventing their separation and locking an engaged strike 20, the end 83 is displaced from the contacts 84 so as not to interfere with their closing.

This embodiment may also provide for a pivoting strike sensor 86 having a first end 88 positioned between the arms 36 and within the opening 22 as shown in FIG. 8*a*. In this state, a second end 90 of the strike sensor 86 also engages the contacts 84 to hold them open independent of the end 83 of the switch linkage 80 when the strike 20 has not been received. As shown in FIG. 8*b*, when the strike 20 is engaged it presses the end 88 of the strike sensor 86 away from the opening 22 causing the strike sensor 86 to pivot about a pivot point 100 displacing end 90 away from the contacts 84 so as not to prevent their closure.

The result is that the contacts 84 may close only when both the collar 72" is engaged on the distal ends 62 locking the strike 20 into the strike retention mechanism 28 and the strike 20 is engaged by the U-shaped spring 32. This approach provides reduced wiring for the communication of both lock state (indicating a locking of the strike retention mechanism 28) and door closure state (indicating engagement of the strike 20 with the U-shaped spring 32).

In one embodiment, (shown in FIG. 8*b*) unlocking motion of the collar 72" after it has been engaged on the distal ends 62 of the arms 36 may be prevented by a stop 102 inserted in the path of the extension 77 (or on any connected linkage) that would be traversed during that unlocking motion. The stop 102 may be moved into position by a wax motor or bimetallic strip actuator 104 wired in parallel or series with actuator 74', the latter which may be a fast acting solenoid. In this manner a fast locking may be obtained through the action of actuator 74' (being one or more solenoids) after which time the stop 102 will be placed according to the thermal time constant of the actuator 104. In the event of power loss, the stop 102 will retain lock of the strike retention mechanism 28 for a period of time required for cooling of the actuator 104 preventing, for example, premature access to the appliance while parts may be in motion.

Alternatively, the actuator 74' may be used alone and may be a thermal actuator if a slow locking speed may be tolerated.

The present invention contemplates that the arms 36 of the U-shaped spring 32 may be coated with a friction reducing substance such as a thermoplastic or may incorporate rollers or the like at points of contact with the strike 20 for the similar purpose, and/or that the strike 20 may be thermoplastic or have a thermoplastic coating over a metal core for similar friction reduction. The U-shaped spring 32 need not in all embodiments be formed of a single metal rod, but may be formed from two wires that are welded together or otherwise attached.

Certain terminology is used herein for purposes of reference only, and thus is not intended to be limiting. For example, terms such as "upper", "lower", "above", and "below" refer to directions in the drawings to which reference is made. Terms such as "left", "right", "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence, or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A latch strike retention assembly adapted to accept and retain a latch strike, the latch strike retention assembly comprising:

a substantially U-shaped spring having opposing and substantially parallel arm portions extending from a common base portion;

a support bracket adapted to position the U-shaped spring behind an opening through which the latch strike must pass, so that the arm portions of the U-shaped spring extend generally perpendicular to a direction of strike engagement with the arm portions and the arm portions may flexibly separate within a plane perpendicular to the direction of the latch engagement to receive and restrain the latch strike there between;

further including a collar movable relative to the U-shaped spring between:

(a) a first locked position at least partially surrounding the arm portions of the U-shaped spring preventing separation of the arm portions to release the latch strike after the latch strike has passed through the U-shaped spring and (b) a second unlocked position removed from the arm portions of the U-shaped spring permitting separation of the arm portions to release the latch strike after the latch strike has passed through the U-shaped spring;

wherein the U-shaped spring is held substantially fixed with respect to the support bracket and the collar is movable with respect to the support bracket;

further including an electrically powered actuator moving the collar with respect to the support bracket between the locked and unlocked position in response to an electrical signal;

wherein the electrically powered actuator is at least one electrical solenoid;

wherein further including a thermal actuator preventing movement of the collar from the locked position to the unlocked position when power is disconnected from the electrical solenoid for a predetermined period of time corresponding to a thermal cooling.

2. The latch strike retention assembly of claim 1 wherein the support bracket is a thermoplastic material.

3. The latch strike retention assembly of claim 2 wherein the support bracket includes apertures receiving arm portions of the U-shaped spring when the arm portions are inserted into the apertures along the plane.

4. The latch strike retention assembly of claim 3 wherein the support bracket further includes a snap element capturing the base portion of the U-shaped spring against extraction from the apertures along the plane after insertion of the arm portions into the apertures past the snap element.

5. The latch strike retention assembly of claim 1 wherein the U-shaped spring is a single rod of substantially circular cross-section.

6. The latch strike retention assembly of claim 1 wherein arm portions of the U-shaped spring distal to a point of engagement with the latch strike have an un-flexed separation smaller than a corresponding thickness of the latch strike between the arm portions when the latch strike is engaged with the U-shaped spring.

7. The latch strike retention assembly of claim 1 wherein arm portions of the U-shaped spring at a point of engagement with the latch strike have an un-flexed separation smaller than a corresponding thickness of the latch strike at the point of engagement.

8. The latch strike retention assembly of claim 1 wherein the arm portions of the U-shaped spring extend at least three times the width of the base portion measured perpendicularly to the extent of the arm portions.

9. The latch strike retention assembly of claim 1 wherein further including a strike sensor communicating with a first contact set to provide a signal dependent on engagement of the latch strike with the U-shaped spring.

10. The latch strike retention assembly of claim 9 wherein the collar further communicates with the first contact set to provide a signal dependent on engagement of the collar with the arm portions of the U-shaped spring.

11. A latch assembly for use in a dryer of a type having a metallic housing providing an opening therein: a drum assembly within the housing for receiving clothes through the opening to tumble the clothes concurrent with a circulation of warm air; a door hingeably covering the opening and supporting a strike having a bulbous tip extending inward from the door to pass through an aperture in the metallic housing when the door is closed; the latch assembly for receiving the latch strike positioned behind the aperture within the housing, the latch assembly comprising:

(a) a substantially U-shaped metal spring having opposing and substantially parallel arm portions extending along an axis from a common base portion to arm ends;

(b) a support bracket adapted to position the U-shaped spring behind an opening in a metal material through which the latch strike must pass, the opening having a height exposing parallel straight arm portions of the U-shaped spring for a distance along the axis greater than a height of the bulbous end received through the parallel straight arm portions to accommodate movement of the latch strike with respect to the opening from sag in the door to which the latch strike may be attached, so that the arm portions of the U-shaped spring extend generally perpendicular to a direction of strike engagement with the arm portions and the arm portions may flexibly separate within a plane perpendicular to the direction of the latch engagement to receive and restrain the latch strike there between;

further including a collar movable relative to the U-shaped spring between:

(a) a first locked position surrounding the arm ends of the arm portions of the U-shaped spring removed from the opening and preventing separation of the arm ends to release the latch strike after the latch strike has passed through the U-shaped spring and (b) a second unlocked position removed from the arm ends of the U-shaped spring permitting separation of the arm ends to release the latch strike after the latch strike has passed through the U-shaped spring;

wherein the U-shaped spring is held substantially fixed with respect to the support bracket and the collar is movable with respect to the support bracket;

further including an electrically powered actuator moving the collar with respect to the support bracket between the locked and unlocked position in response to an electrical signal;

wherein the electrically powered actuator is at least one electrical solenoid;

wherein further including a thermal actuator preventing movement of the collar from the locked position to the unlocked position when power is disconnected from the electrical solenoid for a predetermined period of time corresponding to a thermal cooling.

* * * * *